United States Patent [19]

Kolesky

[11] Patent Number: 5,062,213

[45] Date of Patent: Nov. 5, 1991

[54] CONSTRUCTION SQUARE

[76] Inventor: Eugene H. Kolesky, 17231 Community Street, Lansing, Ill. 60438

[21] Appl. No.: 600,837

[22] Filed: Oct. 22, 1990

[51] Int. Cl.[5] ..... B43L 7/00

[52] U.S. Cl. ..... 33/479; 33/427; 33/464

[58] Field of Search ..... 33/479, 427, 464, 474, 33/452, 455, 469, 482, 483, 484, 497, 499, 500

[56] References Cited

U.S. PATENT DOCUMENTS

| | | | |
|---|---|---|---|
| 888,070 | 5/1908 | Dissell | 33/464 |
| 1,231,120 | 6/1917 | Brasseur | 33/479 |
| 1,525,231 | 2/1925 | Demming | 33/469 |
| 2,028,052 | 1/1936 | Easterly . | |
| 2,521,934 | 9/1950 | Mitchell | 33/484 |
| 2,594,844 | 4/1952 | Bauerle | 33/479 |
| 2,908,079 | 10/1959 | Barrett . | |
| 3,094,787 | 6/1963 | Moore | 33/464 |
| 3,273,246 | 9/1966 | Siberini . | |
| 3,484,945 | 12/1969 | Clark | 33/464 |
| 3,678,588 | 7/1972 | Isola . | |
| 4,403,423 | 9/1983 | Ford et al. | 33/474 |
| 4,599,805 | 7/1986 | Padilla | 33/464 |
| 4,641,435 | 2/1987 | Brown | 33/427 |
| 4,825,559 | 5/1989 | Santos | 33/464 |
| 4,882,846 | 11/1989 | Reed | 33/464 |

FOREIGN PATENT DOCUMENTS

| | | | |
|---|---|---|---|
| 20080 | 6/1903 | United Kingdom | 33/479 |

*Primary Examiner*—William A. Cuchlinski, Jr.
*Assistant Examiner*—C. W. Fulton
*Attorney, Agent, or Firm*—Niro, Scavone, Haller & Niro

[57] ABSTRACT

The present invention relates to an improved construction square which is both durable, simple to manufacture and use, and inexpensive, and that provides the ability to quickly tighten diverse blade configurations into proper position for use.

13 Claims, 1 Drawing Sheet

CONSTRUCTION SQUARE

BACKGROUND OF THE INVENTION

The present invention relates generally to an improved construction square for use in measuring distances from edges, determining angles and for aligning members. More particularly, the present invention relates to an improved construction square device that is rugged, inexpensive and can be used with a variety of angular blades.

It is well known to use various types of construction square measuring devices, such as "T-squares" or slide rules. However, these measuring devices often lack the durability necessary for constant and rough outdoor use. Additionally, many of these devices are relatively complex, unwieldy and expensive. Moreover, the prior devices do not have the ability to quickly and adjustably secure different blade configurations into proper position.

For example, U.S. Pat. Nos. 4,641,435 to Brown, and 2,028,052 to Easterly, each disclose construction squares. However, squares of these types are difficult to conveniently carry and use on a job site and do not offer readily changeable angles. Another example of known devices is shown in U.S. Pat. No. 4,825,559, to Santos, which discloses a pregauging tool. However, to change blades in Santos, the blade must first be positioned to straddle a pair of L-shaped legs located on a flange, and then four Allen screws must be tightened to securely mount the flange member to the blade. Additionally, the transmutable rule disclosed in U.S. Pat. No. 4,599,805, to Padilla, can only be used properly with blades which contain a longitudinal slot along the entire length of the blade. Devices of this type are also unwieldy.

SUMMARY OF THE INVENTION

The present invention preserves the advantages of known construction square devices. In addition, it provides new advantages not found in currently available devices and overcomes many of the disadvantages associated with the known devices.

Accordingly, an object of the present invention is to provide an improved construction square that can adjustably secure diverse blades with different configurations.

An additional object of the present invention is to provide a construction square with a locking mechanism of simple construction which quickly and effectively secures a blade to allow enhanced operator control.

Another object of the present invention is to provide a construction square with a compact and durable handle.

A further object of the present invention is to provide an easy-to-use construction square that is also inexpensive to manufacture.

Yet another object of the present invention is to provide an improved construction square device which will be durable and be able to withstand constant outdoor use.

In accordance with the present invention an improved construction square device is provided which utilizes a handle with a slot, a blade, and means for properly positioning and quickly tightening the blade within the slot. The present invention includes a compact handle which houses a locking mechanism that may be used to adjustably secure either a straight blade or a blade manufactured to any desired angle. A device according to the present invention is durable, simple to manufacture and use, and relatively inexpensive to produce.

BRIEF DESCRIPTION OF THE DRAWINGS

These and other features and advantages of the present invention, will become apparent by reference to the following description and drawings wherein like reference numerals represent like elements throughout the several views and in which.

DETAILED DESCRIPTION OF THE PREFERRED EMBODIMENT

Figure 1:
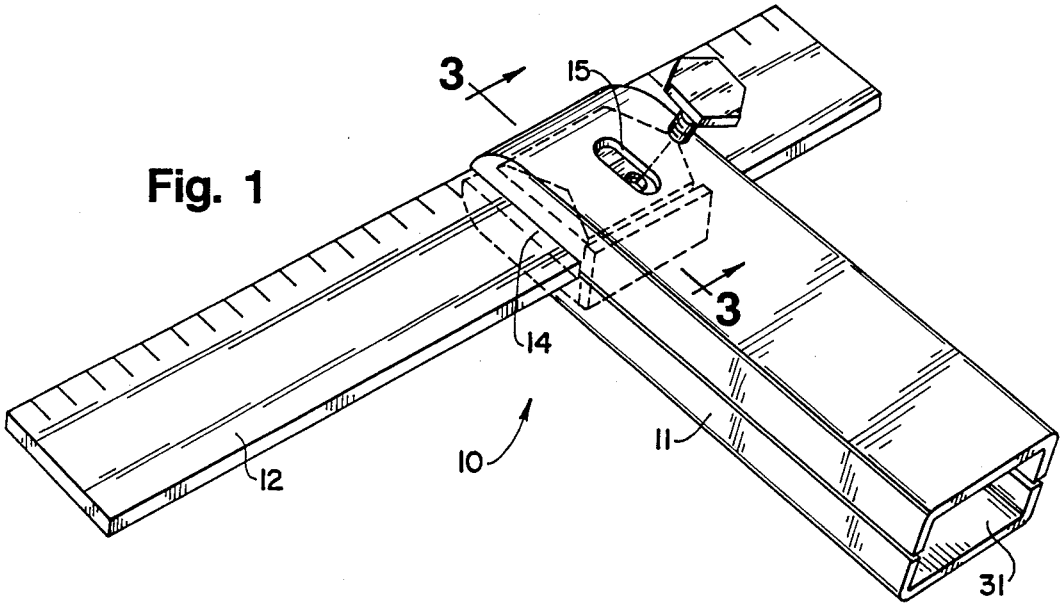
FIG. 1 is a perspective view of the present invention showing the internal components of the locking mechanism in phantom lines.

The improved construction square device of the present invention is shown generally as 10 in FIG. 1. The construction square 10 generally includes a body or handle 11, a blade 12 and a locking means, the components of which are shown generally as 13 in FIG. 2.

Again, with reference to FIG. 1, handle 11 has a side slot 14 which is sized to accommodate blade 12. Handle 11 is also provided with an upper slot 15 on its top surface. Handle 11 may be made of a variety of materials such as metal, aluminum or plastic, consistent with the desired cost goals and the environment for which it is to be used. Additionally, handle is sized to appropriately accommodate blade 12 and locking means 13, which may also be a variety of configurations consistent with the present invention. Finally, handle 11 can be manufactured in two halves (split along the seam shown in FIG. 1); the halves of which can be fastened by screws or other means.

Figure 2:
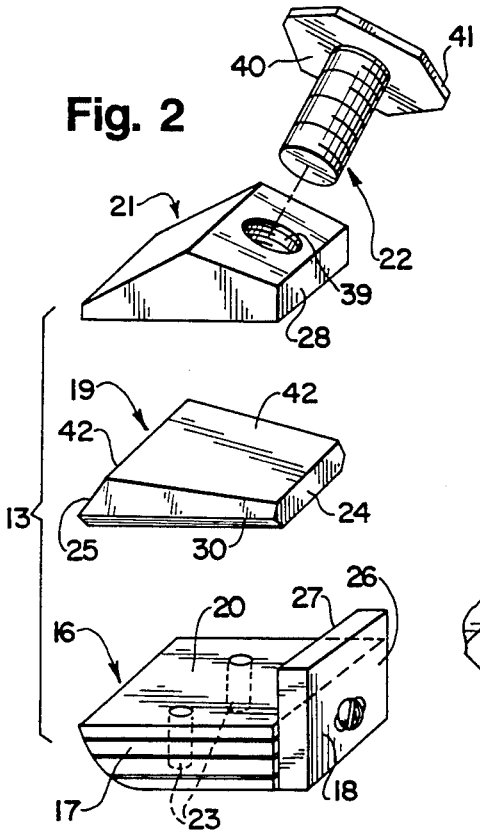
FIG. 2 is an exploded perspective view of various components of a locking mechanism of the present invention.

The components of a preferred embodiment of the locking mechanism of the present invention can best be seen by reference to FIG. 2. In a preferred embodiment, locking means 13 includes a blade guide, designated generally as 16, having a seat portion 17 and rear guide portion 18. Rear guide 18 has an outer face 26 and an inner face 27. A filler wedge 19 is provided having a rear edge 24 and a forward edge 25, and is sized to conform to the dimensions of an upper face 20 of seat 17. Filler wedge 19 may also include beveled edges 30.

Locking means 13 also includes a cam lock 21 which is designed (and sized) to cooperate with filler wedge 19. In a preferred embodiment, cam lock 21 is provided with a threaded bore 39 which is sized to accommodate a thumb lock 22. Cam lock 21 also includes an inner face 28. Blade guide 16 may include threaded holes 23 to accommodate fastening means (not shown) which can be inserted through handle 11 in order to secure blade guide 16 to the forward interior of handle 11 (See also FIG. 3). However, blade guide 16 can also be manufactured (for example, injection molded) as an integral piece of handle 11; this embodiment is preferred, as it assures that the components of the locking means will generally remain in position, even when thumb lock 22 is not present.

Figure 3:
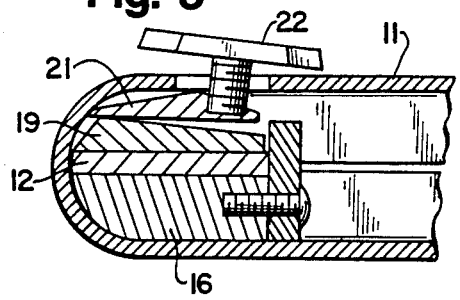
FIG. 3 is a cross-sectional view, taken along line 3—3 of FIG. 1, of the locking mechanism in operational engagement with the blade of the present invention.

The assembly and operation of the present invention may best be understood by reference to FIGS. 2 and 3. Filler wedge 19 is placed over blade guide 16, on the open face 20 of seat 17. Rear edge 24 of generally trapezoidally-shaped filler wedge 19 abuts the inner face 27 of rear guide 18. Cam lock 21 is then placed on filler wedge 19, with inner face 28 of cam lock 21 abutting inner face 27 of the rear guide 18. With the components so arranged, the three-piece locking means designated generally as 13 is inserted into an opening 31 of handle 11. The assembly is inserted with inner face 27 of blade guide 16 facing the direction of insertion. The assembly is then directed to the front of handle 11 (i.e., the end closest to side slot 14), until it abuts the inside front edge of handle 11. The assembly can then be secured with fastening means inserted through threaded holes 23, as previously described. (Note that if blade guide 16 is manufactured as an integral portion of handle 11, then the assembly process described above will take place in one halve of handle 11. When complete, the other halve of handle 11 will be fastened by any appropriate fastening means).

With the handle and locking means in an assembled position, blade 12 is inserted into side slot 14. The bevelled edges 30 of filler wedge 19 allow easy insertion of the blade 12. When blade 12 is inserted to rest on open face 20 of seat 17, it abuts inner face 27 of rear guide portion 18 and is therefore easily and properly positioned. In the preferred embodiment, thumb lock 22 is then screwed into aperture 39 located on cam lock 21, but not so far as to protrude through the aperture on cam lock 21 and abut the top face of filler wedge 19. In this preferred embodiment, thumb lock 22 is slid forward (in a direction away from opening 31) in upper slot 15, thus moving cam lock 21 forward and up ramp 42 of filler wedge !9. This causes cam lock 21 to become frictionally positioned in place, as shown in FIG. 3. Note that the narrow front edge of cam lock 21 (the edge farthest from opening 31) widens into a maximum thickness in the middle portion of cam lock 21. Thus, when thumb lock 22 is moved forward in upper slot 15, the ever-widening front edge of cam lock 21 quickly contacts the inner most forward surface of handle 11. Now, when thumb lock 22 is only slightly tightened, the underside 40 of thumb lock 22 and the upper surface of handle 11 meet, causing the components of the locking means to immediately tighten and affix blade 12 securely in position.

Figure 4:
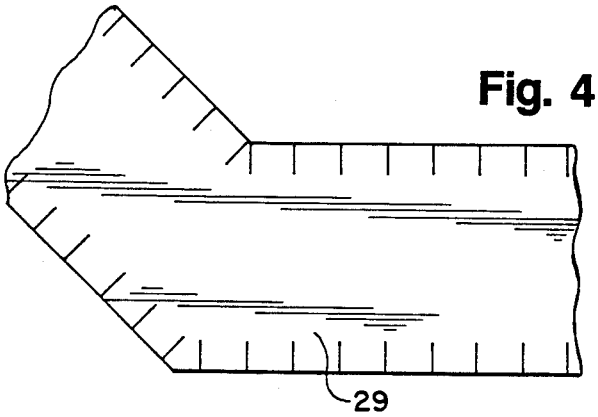
FIG. 4 is a top elevational view of an alternate blade configuration of the present invention.

By alternately loosening and tightening thumb lock 22, blade 12 can be quickly adjusted or removed and alternate blade 29 (FIG. 4) can be inserted and fixed in position. Further, once inserted, blade 12 may be easily positioned to protrude from side slot 14 any desired amount.

Alternative embodiments are also possible, though not preferred. For instance, thumb lock 22 can be screwed into aperture 39 of cam lock 21 a sufficient distance so as to protrude through the aperture on cam lock 21 and abut the top face of filler wedge 19. Now, as thumb lock 22 is tightened, the distance between the underside 40 of thumb lock 22 to the upper surface of handle 11 decreases, until eventually these surfaces are contiguous. This causes the components of the locking means to tighten and affix blade 12 securely in position. In still another embodiment, cam lock 21 has no aperature. Now, thumb lock 22 is screwed into upper slot 15 until it abuts the top face of cam lock 21. Again, as thumb lock 22 is tightened, the components of the locking means will tighten and affix blade 12 in a proper, rigid position.

In the preferred embodiment, the unique sloping trapezoidal shape of filler wedge 19 allows cam lock 21 to more easily rotate in a rocking motion about edge 42 of filler wedge 19. Filler wedge 19 also decreases the need for a large angular movement on the part of cam lock 21, as filler wedge 19 allows cam lock 21 to initially be positioned closer to the inner front-most surface of handle 11. The unique geometry of the components of locking means 13, including the cam lock mechanism with cam lock 21 and filler wedge 19, thus allows the locking means to squeeze tightly about blade 12 after only a small turn of thumb lock 22.

The three-piece locking assembly 13 is designed to give the operator enhanced control over the positioning of blade 12. Filler wedge 19 allows a quicker tightening of the assembly 13 by allowing the cam tightening mechanism to utilize three pairs of interacting, frictional surfaces. Thus, two pairs of frictional surfaces (open face 20 of seat 17 with one surface of blade guide 12, and the lower face of filler wedge 19 with the other surface of blade guide 12) are developed while a different pair of frictional surfaces (the long upper face of filler wedge 19 and the lower face of cam lock 21) are developed below cam lock 21.

Compact handle 11 is generally designed to be small enough to be hand-held and easily useable with one hand. Blade 12 may have scale gradations cut into them, using methods well know in the prior art. Additionally, each component of the present invention can be injection molded for a precise fit.

It should also be understood that the components of locking mechanism 13 may be of other geometric shapes and configurations to provide adequate locking force for blade 29, consistent with the present invention.

While preferred embodiments of the present invention have been illustrated and described, it will be understood by those of ordinary skill in the art that changes and modifications can be made without departing from the invention in the broader aspects. Various features of the present invention are set forth in the following claims.

What is claimed is:

1. An improved construction square for releasably securing a blade, comprising;

a handle;

a locking mechanism for tightening said blade within said handle, said locking mechanism being housed within said handle and including a trapezoidal-shaped filler wedge seated on the horizontal portion of an L-shaped blade guide, and a generally rectangular member positioned above and adjacent to said filler wedge, the top face of said generally rectangular member including two sloping sides and an aperture.

2. The improved construction square of claim 1, wherein said filler wedge includes two beveled edges.

3. An improved construction square for releasably securing a blade, comprising:

a handle with a slot;

locking means for positioning and tightening the blade within said slot, said locking means including a generally rectangular member with narrow edges and a substantially wider middle portion; a generally trapezoidal-shaped member; and a generally L-shaped member, said L-shaped member including a seat portion connected to a back portion; wherein said locking means and said blade include three pairs of interacting frictional surfaces.

4. An improved construction square for releasably securing a blade, comprising:

a handle with a slot;

locking means for positioning and tightening said blade within said slot, said locking means including a generally rectangular member, said generally rectangular member having narrow edges and a substantially wider middle portion; and a generally trapezoidal-shaped member having one base longer than its other base; wherein said locking means and said blade include three pairs of interacting frictional surfaces.

5. An improved construction square for releasably securing a blade, comprising:

a handle adapted to accomodate the blade;

locking means positioned within said handle, said locking means including a housing and seating means adapted to support said housing; and tightening means adapted to cooperate with said housing such that when the blade is inserted within said handle, and pressure is exerted by said tightening means on said locking means, said housing and said seating means cooperate to fixably secure a portion of said blade within said locking means and said handle.

6. The improved construction square of claim 5, wherein said handle includes a slot and an aperture located on the top of said handle near said slot, and said housing includes an aperture, such that said a portion of said tightening means can be inserted through the apertures on said handle and said housing.

7. The improved construction square of claim 6, wherein said slotted handle has a curved periphery at the end of the handle which includes the slot.

8. The improved construction square of claim 7, wherein said housing includes a narrow portion located near said curved periphery of said handle, and a wide portion.

9. The improved construction square of claim 5, wherein said locking means includes a filler wedge positioned between said seating means and said housing, said filler wedge having beveled edges to facilitate insertion of the blade between said filler means and said seating means.

10. The improved construction square of claim 9, wherein said filler means is generally trapezoidal-shaped.

11. The improved construction square of claim 9, wherein said seating means includes an upwardly extending back for supporting said housing and said filler means.

12. The improved construction square of claim 6, wherein said tightening means includes a threaded member which is adapted to be inserted through the apertures on said handle and said housing, said threaded member being manually rotatable and serving to tighten said locking mechanism about a portion of said blade.

13. An improved construction square for releasably securing a blade, comprising:

a handle having a slot and a curved periphery at the handle end which includes the slot, and an aperture located on the top of said handle near said slot;

locking means positioned within said handle near said curved periphery, said locking means including:

(a) a housing having a narrow portion located near said curved periphery of said handle, a wide portion, and an aperture;

(b) a generally trapezoidal-shaped filler means with beveled sides for facilitating insertion of the blade; and (c) seating means;

said filler means being positioned beneath said housing, and said seating member adapted to support said filler means and said housing, said seating means including a horizontal seat portion and an upwardly extending back; and means for tightening the handle within said locking means, said tightening means including a threaded member sized for insertion through the apertures on said handle and said housing, said threaded member being manually rotateable, such that when the blade is inserted within the slot of said handle and between said seating means and said filler means, and pressure is exerted by said threaded member, said housing, said filler means and said seating means all cooperate to fixably secure a portion of said blade within said locking means and said handle.

* * * * *